US010494161B2

(12) United States Patent
Fosse

(10) Patent No.: US 10,494,161 B2
(45) Date of Patent: Dec. 3, 2019

(54) TAMPER EVIDENT CONTAINER

(71) Applicant: Lindar Corporation, Baxter, MN (US)

(72) Inventor: Daniel K. Fosse, Cambridge, MN (US)

(73) Assignee: Lindar Corporation, Baxter, MN (US)

( * ) Notice: Subject to any disclaimer, the term of this patent is extended or adjusted under 35 U.S.C. 154(b) by 440 days.

(21) Appl. No.: 15/089,161

(22) Filed: Apr. 1, 2016

(65) Prior Publication Data

US 2017/0283139 A1 Oct. 5, 2017

(51) Int. Cl.

| | |
|---|---|
| ***B65D 55/02*** | (2006.01) |
| ***B65D 43/16*** | (2006.01) |
| ***B65D 43/22*** | (2006.01) |
| ***B65D 55/06*** | (2006.01) |

(52) U.S. Cl.

CPC ..... *B65D 55/024* (2013.01); *B65D 43/162* (2013.01); *B65D 43/22* (2013.01); *B65D 55/06* (2013.01); *B65D 2543/00833* (2013.01)

(58) Field of Classification Search

CPC .... B65D 55/024; B65D 55/06; B65D 43/162; B65D 43/22; B65D 2543/00833; B65D 17/20

USPC ..... 220/270, 833–835, 839

See application file for complete search history.

(56) References Cited

U.S. PATENT DOCUMENTS

| | | | | |
|---|---|---|---|---|
| 4,986,438 | A * | 1/1991 | Borst | B65D 43/0218 220/315 |
| 7,073,680 | B2 | 7/2006 | Boback et al. | |
| 7,118,003 | B2 | 10/2006 | Sellari et al. | |
| 7,243,813 | B2 | 7/2007 | Krueger | |
| D698,241 | S | 1/2014 | Fosse | |
| 8,807,385 | B1 | 8/2014 | Fosse | |
| 2003/0121917 | A1* | 7/2003 | Fore | B65D 1/26 220/4.22 |
| 2008/0087669 | A2 | 4/2008 | Boback et al. | |
| 2009/0206082 | A1* | 8/2009 | Vovan | B65D 43/0249 220/266 |
| 2010/0140267 | A1 | 6/2010 | Sellari et al. | |
| 2011/0056976 | A1* | 3/2011 | Chen | B65D 43/162 220/833 |
| 2012/0103990 | A1* | 5/2012 | McCumber | B65D 41/165 220/270 |
| 2014/0027458 | A1* | 1/2014 | Liu | B65D 43/164 220/270 |
| 2014/0209607 | A1* | 7/2014 | Fosse | B65D 43/162 220/270 |

(Continued)

OTHER PUBLICATIONS http://www.inlineplastics.com/safe_t_fresh.php Inline Plastics Corporation.

(Continued)

*Primary Examiner* — James N Smalley
(74) *Attorney, Agent, or Firm* — Kinney & Lange, P.A.

(57) ABSTRACT

A tamper evident closure includes a first snap, a second snap, a tear strip connected to the second snap, a third snap connected to the tear strip, and a first projection extending around three sides of the first snap. In a closed position, a cavity of the second snap is configured to be placed over the first snap, and the third snap is configured to be placed in a cavity in the first snap. Further, in a closed position, the first projection is configured to surround three sides of the third snap that has been placed in a cavity in the first snap.

22 Claims, 8 Drawing Sheets

(56) References Cited

U.S. PATENT DOCUMENTS

| | | | |
|---|---|---|---|
| 2017/0361980 | A1 | 12/2017 | Fosse |
| 2018/0093800 | A1 | 4/2018 | Fosse |

OTHER PUBLICATIONS http://www.dartcontainer.com/web/products.nsf/files/M-204.pdf/$FILE/M-204.pdf Dart Container Corporation.
http://www.parpak.com/brochures/BreakAway-OCT10-ENG.pdf Par-Pak Corporation, Oct. 2010.
http://www.pactiv.com/products_na/foodservice/data/PWPTamperEvident.pdf PACTIV Foodservice/Food Packaging.
http://www.pactiv.com/Products_NA/Foodservice/data/TESquares.pdf PACTIV Foodservice/Food Packaging.

* cited by examiner

TAMPER EVIDENT CONTAINER

BACKGROUND

The present invention relates to containers, and in particular, to a tamper evident design for containers.

Containers can be constructed with various structures and sizes. Two common container structures include clamshell containers and multi-piece containers. Clamshell containers are containers that mimic the form and function of a clamshell. Clamshell containers include a base portion and a cover portion that are attached to one another with a hinge. Multi-piece containers are containers that include a base portion and a cover portion that are separate pieces designed to fit together. Typically, both clamshell containers and multi-piece containers have some form of closure that is capable of holding the cover portion on the base portion when the container is closed. Different types of closures can be used, including self-locking tabs, snaps, or screw tops. Containers can also be held together with means other than closures. These means can include using frictional forces to hold container pieces together, heat sealing the container pieces together, or using staples, adhesives, or labels to hold the container pieces together.

Containers are typically secured using standard closures that allow a user to open and close the container with no consequence. Containers can also be secured with tamper evident or tamper proof closures. These types of closures include a feature that will make it obvious that the container has been opened. A container with a tamper evident or a tamper proof closure will be irreversibly altered when the container is opened for the first time.

SUMMARY

A tamper evident closure includes a first snap, a second snap, a tear strip connected to the second snap, a third snap connected to the tear strip, and a first projection extending around three sides of the first snap. In a closed position, a cavity of the second snap is configured to be placed over the first snap, and the third snap is configured to be placed in a cavity in the first snap. Further, in a closed position, the first projection is configured to surround three sides of the third snap that has been placed in a cavity in the first snap.

A method includes closing a tamper evident container by bringing a first container portion into contact with a second container portion. A cavity of a second snap is placed over a first snap. The second snap is connected to a tear strip along a first perforated line and the tear strip is connected to a third snap along a second perforated line. The third snap is folded along the second perforated line and placed in a cavity of the first snap. When the third snap is in the cavity of the first snap, a projection surrounds three sides of the third snap.

DETAILED DESCRIPTION

Containers are used in many industries as a form of packaging for products that are commercially available. To indicate when someone has opened a package, some form of tamper evident or tamper proof means is used. A tamper evident indicator will indicate that the package has been opened, so that someone purchasing or using the product can ensure that the package includes all of the necessary contents and is safe to use.

Figure 1:
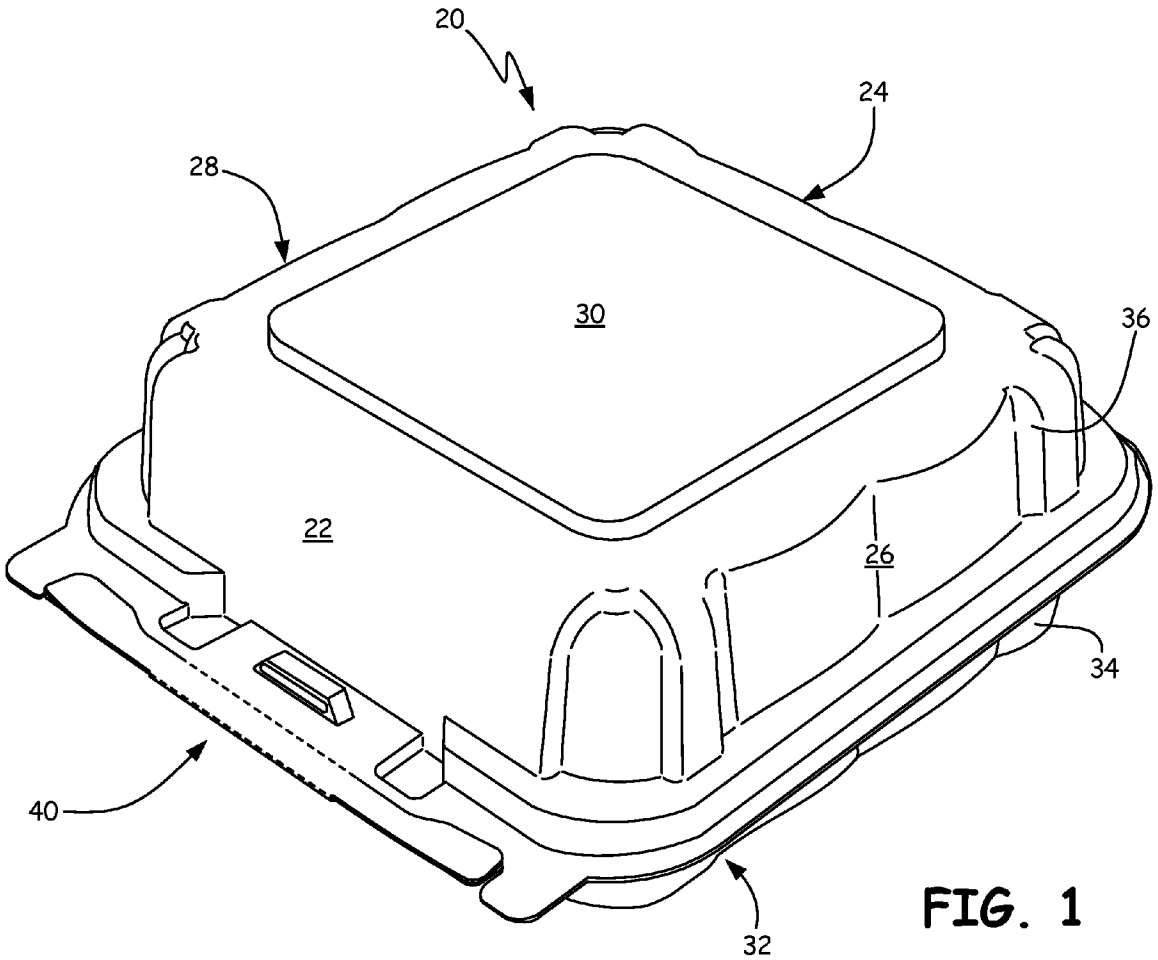
FIG. 1 is a perspective view of a tamper evident container in a closed position.
Figure 2:
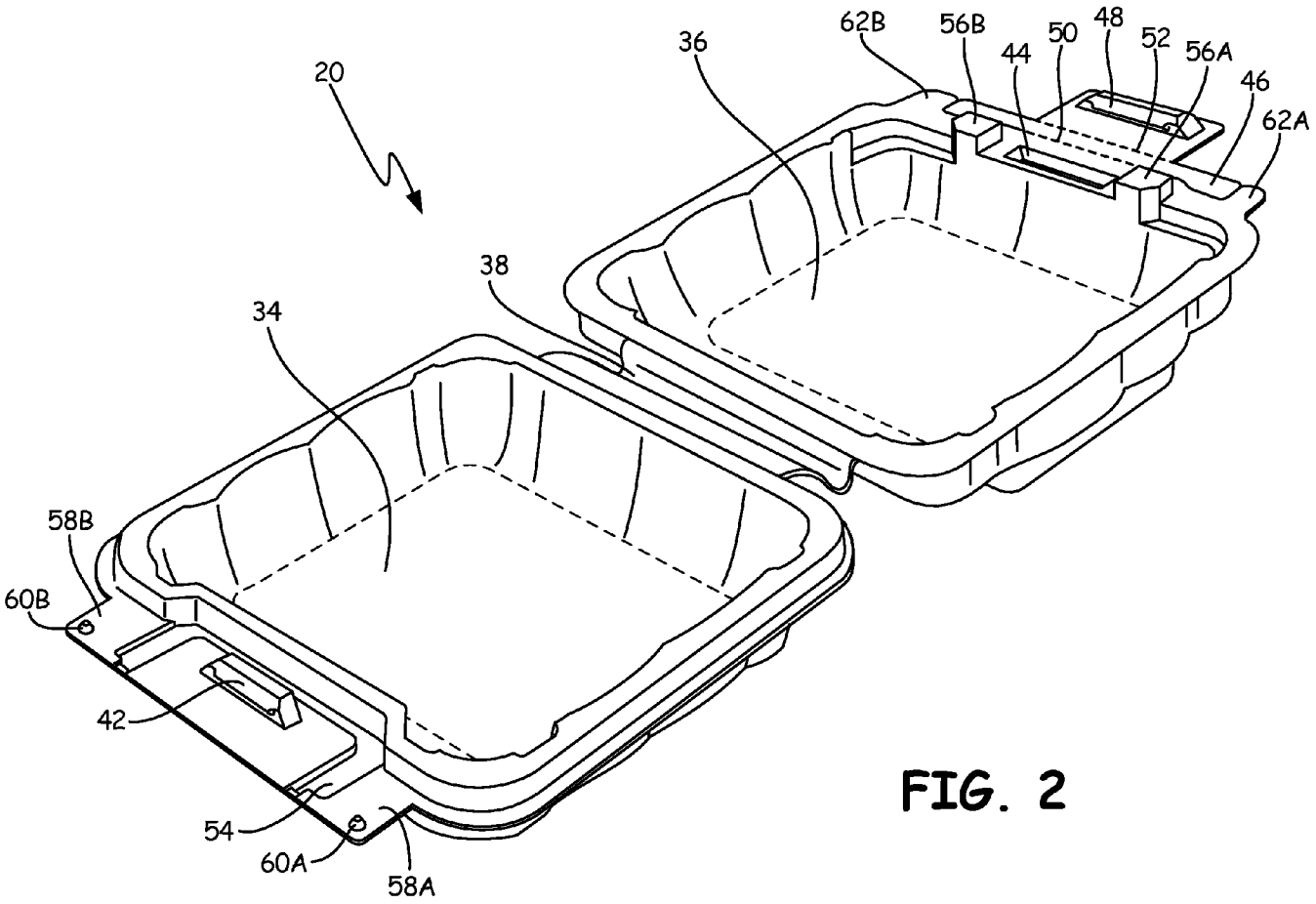
FIG. 2 is a perspective view of the tamper evident container of FIG. 1 in an open position.

FIGS. 1-2 show tamper evident container 20. FIG. 1 is a perspective view of tamper evident container 20 in a closed position. FIG. 2 is a perspective view of tamper evident container 20 in an open position. Tamper evident container 20 includes front side 22, rear side 24, first side 26, second side 28, top side 30, and bottom side 32 when it is in a closed position. Tamper evident container 20 further includes first container portion (base) 34, second container portion (cover) 36, hinge 38, and tamper evident closure 40. Tamper evident closure 40 includes first snap 42, second snap 44, tear strip 46, third snap 48, perforated line 50, perforated line 52, projection 54, projection 56A and projection 56B (collectively "projections 56"), tab 58A and tab 58B (collectively "tabs 58"), bump 60A and bump 60B (collectively "bumps 60"), and tab 62A and tab 62B (collectively "tabs 62").

Container 20 includes first container portion 34 that forms a base of container 20 and second container portion 36 that forms a cover of container 20. First container portion 34 is attached to second container portion 36 along hinge 38. Hinge 38 is located on rear side 24 of tamper evident container 20 when tamper evident container 20 is in a closed position. As seen in FIG. 1, second container portion 36 fits on and seals to first container portion 34 to close container 20. Tamper evident container 20 is made out of plastic in the embodiment shown, but any suitable material can be used.

As seen in FIG. 2, first container portion 34 includes first snap 42 and second container portion 36 includes second snap 44, tear strip 46, and third snap 48. First container portion 34 is integrally formed with first snap 42. Second container portion 36 is integrally formed with second snap 44. Second snap 44 is attached to tear strip 46 along perforated line 50. Third snap 48 is attached to tear strip 46 along perforated line 52. Tamper evident closure 40 is formed by fitting first snap 42, second snap 44, tear strip 46, and third snap 48 together. When tamper evident container 20 is in a closed position, tamper evident closure 40 is located on front side 22 of tamper evident container 20. In alternate embodiments, tamper evident closure 40 may be located on any side of container 20. In further alternate embodiments, container 20 can include a plurality of tamper evident closures 40 that can be located on any side of container 20.

As seen in FIG. 1, when tamper evident container 20 is in a closed position, tamper evident closure 40 is positioned so that tear strip 46 faces upward from tamper evident closure 40. To open tamper evident container 20, a user can grab tear strip 46 between his/her fingers and pull it away from tamper evident container 20. Tear strip 46 is attached to second snap 44 and third snap 48 along perforated line 50 and perforated line 52, respectively. When tear strip 46 is pulled away from tamper evident container 20, perforated line 50 and perforated line 52 separate so that tear strip 46 can be removed from tamper evident container 20. Once tear strip 46 is removed, tamper evident closure 40 can be opened and closed.

First container portion 34 also includes projection 54 that is integrally formed with first container portion 34. Projection 54 is a U-shaped projection that extends around three sides of first snap 42. Second container portion 36 also includes projection 56A and projection 56B. Projection 56A is positioned on a first side of second snap 44 and projection 56B is positioned on a second side of second snap 44. When container 20 is in a closed position, projections 56 sit in a cavity formed in projection 54 with projection 56A on a first side of first snap 42 and projection 56B on a second side of first snap 42.

First container portion 34 further includes tabs 58 and bumps 60. Tabs 58 and bumps 60 are integrally formed with first container portion 34. Tab 58A is positioned on the first side of first snap 42 outward of projection 54 and tab 58B is positioned on the second side of first snap 42 outward of projection 54. Bump 60A is an upward projection from tab 58A and bump 60B is an upward projection from tab 58B. When container 20 is in a closed position, opposite ends of tear strip 46 will sit against bumps 60. Bumps 60 create a gap between tear strip 46 and tabs 58 so that a user can grasp tear strip 46 to remove tear strip 46 from container 20. Second container portion 36 further includes tabs 62 that are integrally formed with second container portion 36. Tab 62A is positioned on a first side of tear strip 46 and tab 62B is positioned on a second side of tear strip 46. After tear strip 46 is removed from container 20, tabs 62 can be grasped to separate second container portion 36 and first container portion 34 to open container 20.

Tamper evident closure 40 creates a container that is tamper evident. To open tamper evident container 20, a user must grab tear strip 46 and pull it away and remove it from tamper evident container 20. When tear strip 46 has been removed from tamper evident container 20, a user knows that tamper evident container 20 has been opened. Once tear strip 46 is removed from tamper evident container 20, a user can open and close tamper evident closure 40. This allows a user to open and close tamper evident container 20 an infinite number of times, even if tamper evident container 20 will no longer have tamper evident features after it is opened for the first time.

Tamper evident closure 40 is simple and intuitive to use. This makes tamper evident closure 40 advantageous, as users do not need to be trained or instructed on how to use tamper evident closure 40. Tamper evident container 20 can be assembled by hand, which allows someone to use the container to package his or her own products. Tamper evident container 20 can also be assembled automatically, thus making tamper evident container 20 suitable for use in large manufacturing operations. Tamper evident container 20 can be used in a variety of different ways. First, tamper evident container 20 can be used to package food. Having a tamper evident package for food is advantageous, as consumers can ensure that the food has not been tampered with prior to purchasing it. Second, tamper evident container 20 can be used to package products. Having a tamper evident package for products can ensure consumers that all of the parts are in the package and that the product has not been tampered with prior to purchasing it.

Figure 3A:
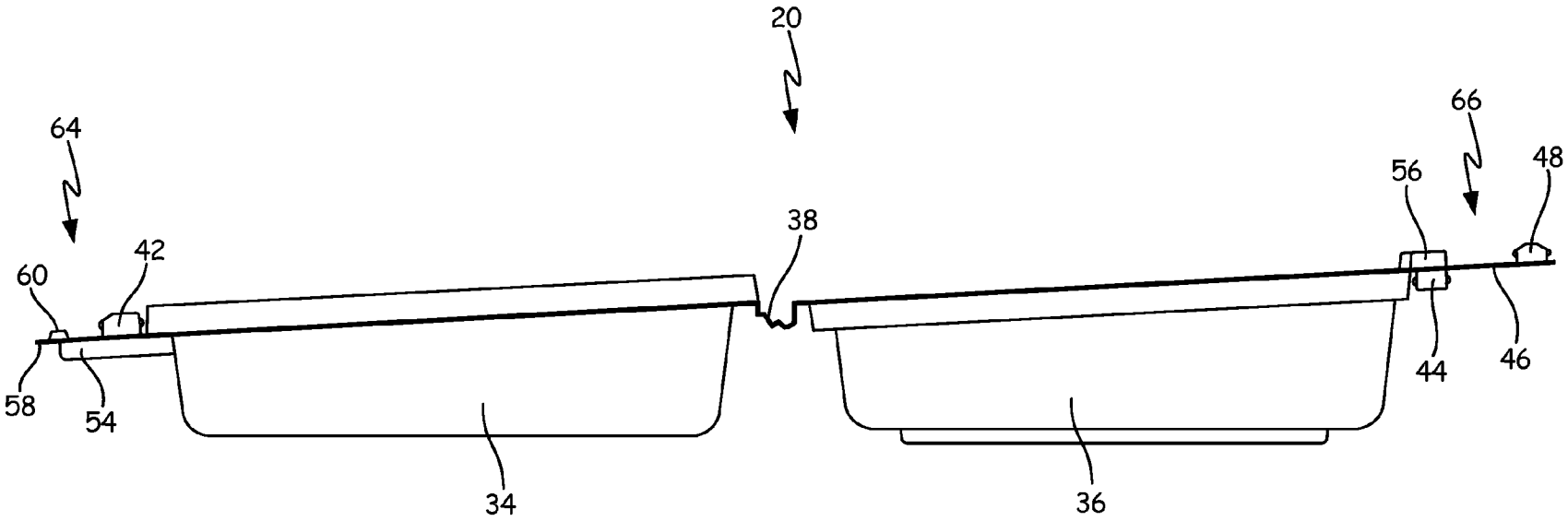
FIG. 3A is a side elevation view of the tamper evident container of FIG. 1 in an open position.
Figure 3B:
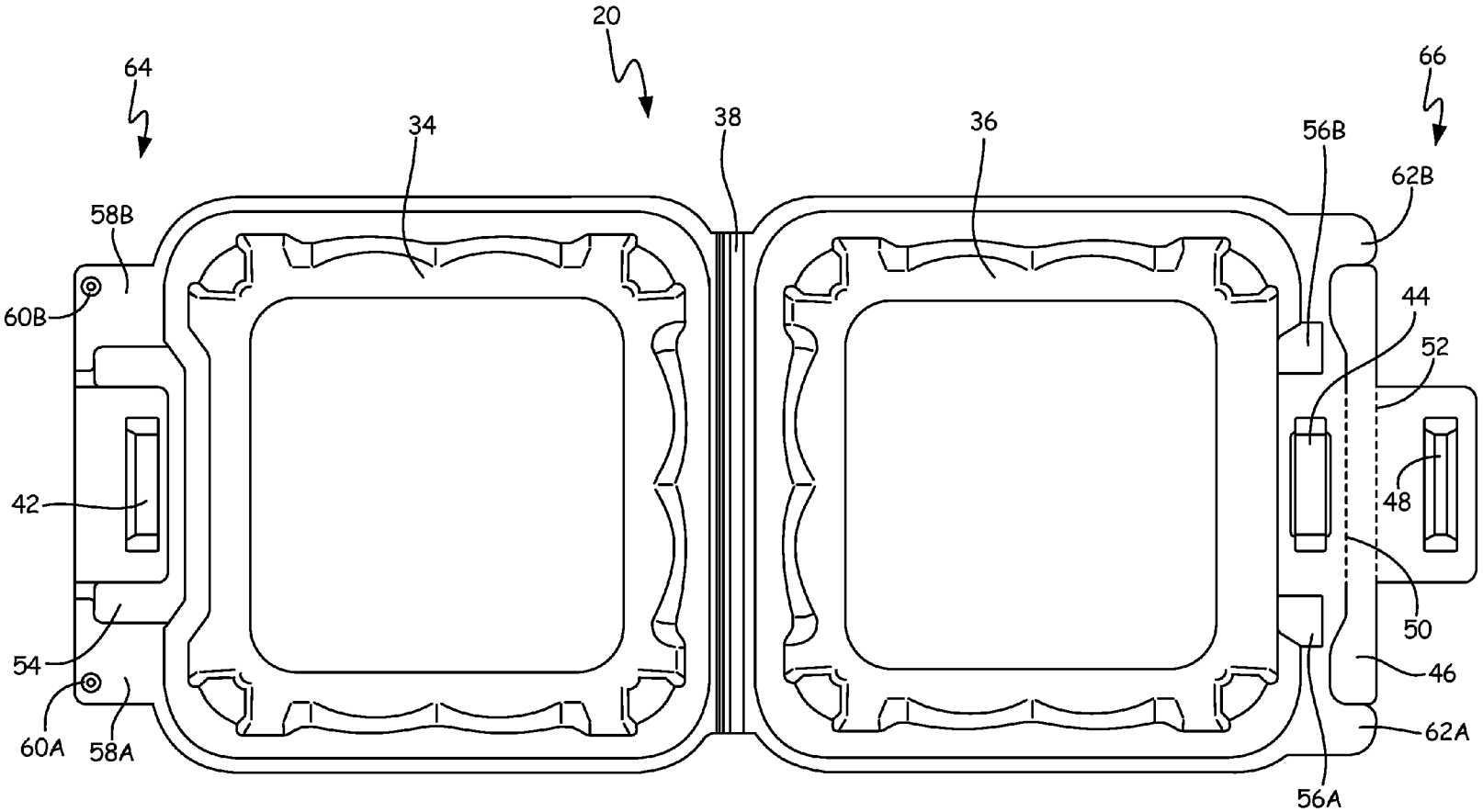
FIG. 3B is a top plan view of the tamper evident container of FIG. 1 in an open position.

FIGS. 3A-3B show tamper evident container 20 in an open position. FIG. 3A is a side elevation view of tamper evident container 20 in an open position. FIG. 3B is a top plan view of tamper evident container 20 in an open position. Tamper evident container 20 includes first container portion 34, second container portion 36, hinge 38, first flange 64, and second flange 66. First flange 64 includes first snap 42, projection 54, tabs 58, and bumps 60. Second flange 66 includes second snap 44, tear strip 46, third snap 48, perforation 50, perforation 52, projections 56, and tabs 62.

First container portion 34 is connected to second container portion 36 along hinge 38. Hinge 38 has a curved shape and can bend when tamper evident container 20 is closed. First flange 64 is attached to first container portion 34. Second flange 66 is attached to second container portion 36.

First flange 64 extends out from first container portion 34. First snap 42, projection 54, tabs 58, and bumps 60 are located on first flange 64. First snap 42 has a substantially rectangular shape and projects upwards from first flange 64. First snap 42 has a cavity formed on the inside of the upward projection that can be accessed on the bottom side of first flange 64. In alternate embodiments, first snap 42 can have any shape, including but not limited to, a square shape, a circular shape, or an oval shape. In further alternate embodiments, first snap 42 can be an opening.

Projection 54 is U-shaped and projects downwards from first flange 64. Projection 54 surrounds first snap 42 on three sides and forms a cavity that can be accessed on the top side of first flange 64. Tabs 58 are flat projections on opposite ends of first flange 64. Tabs 58 can be grasped by a user to open container 20. Bumps 60 are projections on tabs 58 that project upwards from first flange 64.

Second flange 66 extends out from second container portion 36. Second snap 44, tear strip 46, third snap 48, perforated line 50, perforated line 52, projections 56, and tabs 62 are located on second flange 66. Second snap 44 is attached to tear strip 46 along perforated line 50. Tear strip 46 is attached to third snap 48 along perforated line 52. Second snap 44 has a substantially rectangular shape and projects downwards from second flange 66. Second snap 44 has a cavity formed on the inside of the downward projection that can be accessed on the top side of second flange 66. Third snap 48 has a substantially rectangular shape and projects upwards from second flange 66. Third snap 48 has a cavity formed on the inside of the upward projection that can be accessed on the bottom side of second flange 66. In alternate embodiments, second snap 44 and third snap 48 can have any shape, including but not limited to, a square shape, a circular shape, or an oval shape.

Perforated line 50 and perforated line 52 are lines that run across second flange 66. Perforated line 50 and perforated line 52 can be made from perforations of any suitable size. Tear strip 46 has a narrow middle section with bigger tabs on opposite ends of the narrow middle section. The bigger tabs on opposite ends of tear strip 46 make it easy for a user to grasp tear strip 46 on either end to pull tear strip 46 away from container 20. In alternate embodiments, tear strip 46 can have alternate shapes.

Projections 56 project upwards from second flange 66. Projections 56 have a cavity formed on the inside of the upward projections that can be accessed on the bottom side of second flange 66. Tabs 62 are flat projections on opposite ends of second flange 66. Tabs 62 can be grasped by a user to open container 20.

Tamper evident container 20 is manufactured in the open position, as seen in FIGS. 3A-3B. Tamper evident container 20 is manufactured using common container and packaging manufacturing techniques. Manufacturing tamper evident container 20 in the open position allows tamper evident container 20 to be stacked in a substantially flat manner for shipping. This allows multiple containers to be shipped in a single box, which saves space and cost. Being able to stack tamper evident container 20 while it is in the open position also saves space when storing tamper evident container 20.

Figure 4A:
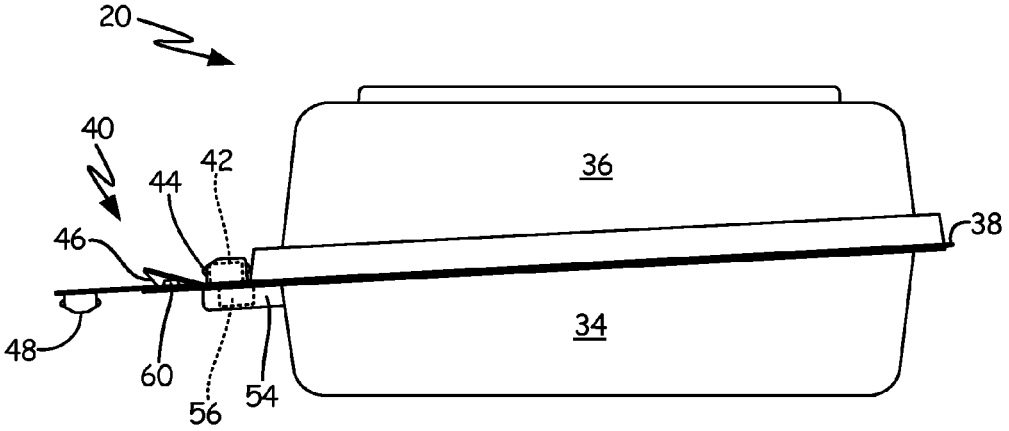
FIG. 4A is a side elevation view of the tamper evident container of FIG. 1 in a partially closed position.
Figure 4B:
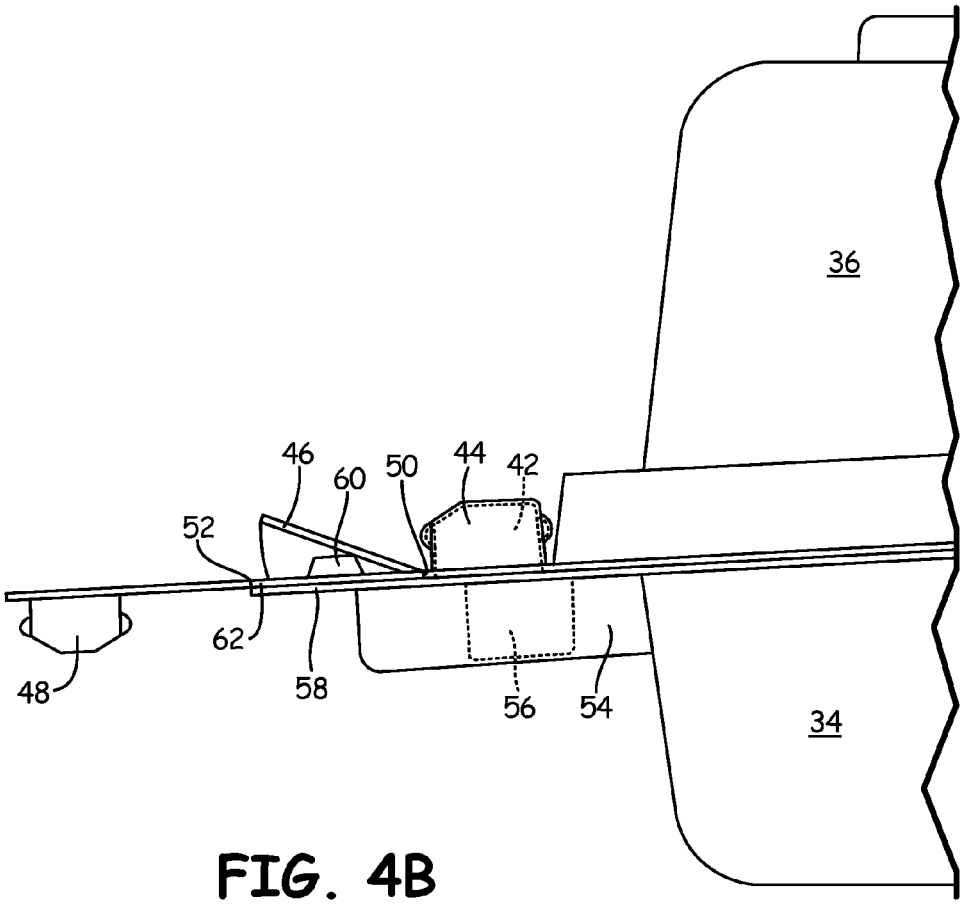
FIG. 4B is a cut-away side elevation view of the tamper evident container of FIG. 1 in a partially closed position.

FIGS. 4A-4B show tamper evident container 20 in a partially closed position. FIG. 4A is a side elevation view of tamper evident container 20 in a partially closed position. FIG. 4B is a cut-away side elevation view of tamper evident container 20 in a partially closed position. Tamper evident container 20 includes first container portion 34, second container portion 36, hinge 38, and tamper evident closure 40. Tamper evident closure 40 includes first snap 42, second snap 44, tear strip 46, third snap 48, perforated line 50, perforated line 52, projection 54, projections 56, tabs 58, bumps 60, and tabs 62.

First container portion 34 is connected to second container portion 36 along hinge 38. In a partially closed position, a rim of first container portion 34 fits on a rim of second container portion 36.

In a partially closed position, the cavity of second snap 44 can be placed around first snap 42. Second snap 44 fits around first snap 42 so that the two portions can be held together with friction forces when there is no outside pressure being applied to them. When outside pressure is applied, second snap 44 can be removed from first snap 42 so tamper evident container 20 can be opened. Specifically, a user can open container 20 by grasping tabs 62 to pull second snap 44 off of first snap 42. First snap 42 and second snap 44 act as a typically snap-lock feature that can be closed and opened with no consequence.

Further, when container 20 is in a partially closed position, projections 56 are placed in the cavity of projection 54 and opposite ends of tear strip 46 abut bumps 60. Bumps 60 create a gap between the opposite ends of tear strip 46 and tabs 58.

Figure 5A:
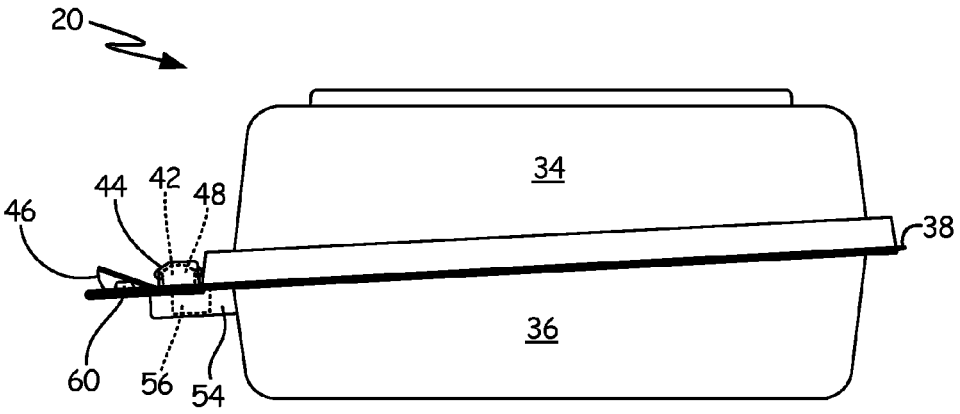
FIG. 5A is a side elevation view of the tamper evident container of FIG. 1 in a closed position.
Figure 5B:
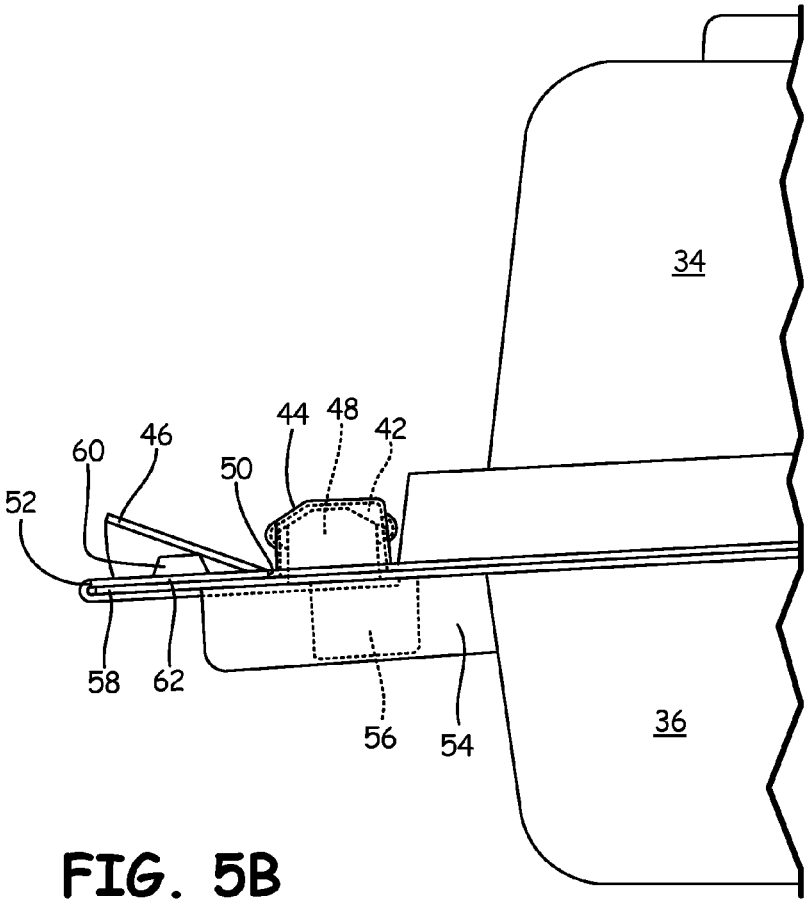
FIG. 5B is a cut-away side elevation view of the tamper evident container of FIG. 1 in a closed position.

FIGS. 5A-5B show tamper evident container 20 in a closed position. FIG. 5A is a side elevation view of tamper evident container 20 in a closed position. FIG. 5B is a cut-away side elevation view of tamper evident container 20 in a closed position. Tamper evident container 20 includes first container portion 34, second container portion 36, hinge 38, and tamper evident closure 40. Tamper evident closure 40 includes first snap 42, second snap 44, tear strip 46, third snap 48, perforated line 50, perforated line 52, projection 54, projections 56, tabs 58, bumps 60, and tabs 62.

To fully close tamper evident container 20, third snap 48 can be folded and placed in the cavity of first snap 42. Third snap 48 is folded along perforated line 56. Third snap 48 is designed to have a tight fit with the cavity of first snap 42 so that there are no voids between the two snaps when tamper evident container 20 is closed. Having a tight fit between third snap 48 and first snap 42 makes it very difficult, if not impossible, for tamper evident container 20 to be opened without permanently altering tamper evident closure 40 or tamper evident container 20.

Placing third snap 48 in first snap 42 leaves tear strip 46 facing upwards from tamper evident container 20. To remove tear strip 46, a user can grab either end of tear strip 46 and pull tear strip 46 outwards and away from tamper evident container 20. The gap formed between the abutment of opposite ends of tear strip 46 and bumps 60 allows a user to easily grasp either end of tear strip 46. When tear strip 46 is pulled away from tamper evident container 20, perforated line 54 and perforated line 56 break apart. This allows for the easy removal of tear strip 46. Once tear strip 46 is removed, tamper evident closure 40 can be opened by pulling second snap 44 off of first snap 42. Third snap 48 remains in the cavity of first snap 42 when second snap 44 is removed from first snap 42.

Third snap 48 is designed to fit tightly in first snap 42 with no voids so that tamper evident container 20 can not be opened without first removing tear strip 46. The tight fit between third snap 48 and first snap 42 reduces the potential of someone being able to open the container with a sharp or pointed object. It also reduces the potential of someone being able to open tamper evident container 20 without first removing tear strip 46. Further, when third snap 48 is folded and placed in first snap 42, projection 54 surrounds three edges of third snap 48. Projection 54 prevents a user from prying third snap 48 out of first snap 42, as it is very difficult, if not impossible, to grasp an edge of third snap 48.

Tamper evident closure 40 is a closure that can be closed for the first time by a user to create a tamper evident seal. After it is opened for the first time and tear strip 46 is removed, tamper evident closure 40 operates like a typical snap-lock closure so that tamper evident container 20 can be opened and closed an infinite number of times. Tamper evident closure 40 is advantageous for this reason, as it allows a user to utilize a tamper evident closure on a container while allowing the container to be opened and closed an infinite number of times after it is opened for the first time. Tamper evident container 20 is permanently altered when tear strip 46 is removed, but the permanent alteration does not prevent a user for opening and closing the container after that point.

Figure 6:
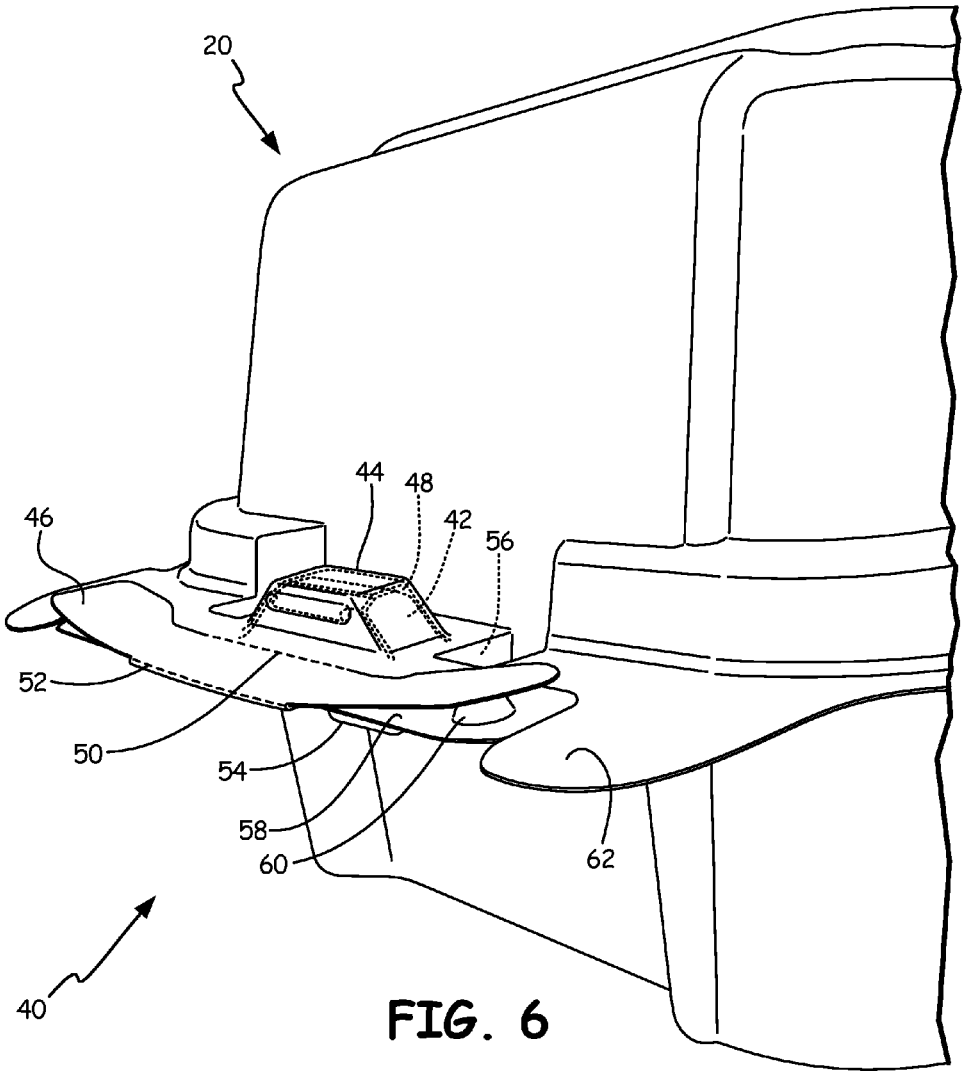
FIG. 6 is a cut-away perspective view of a top side of a tamper evident closure.
Figure 7:
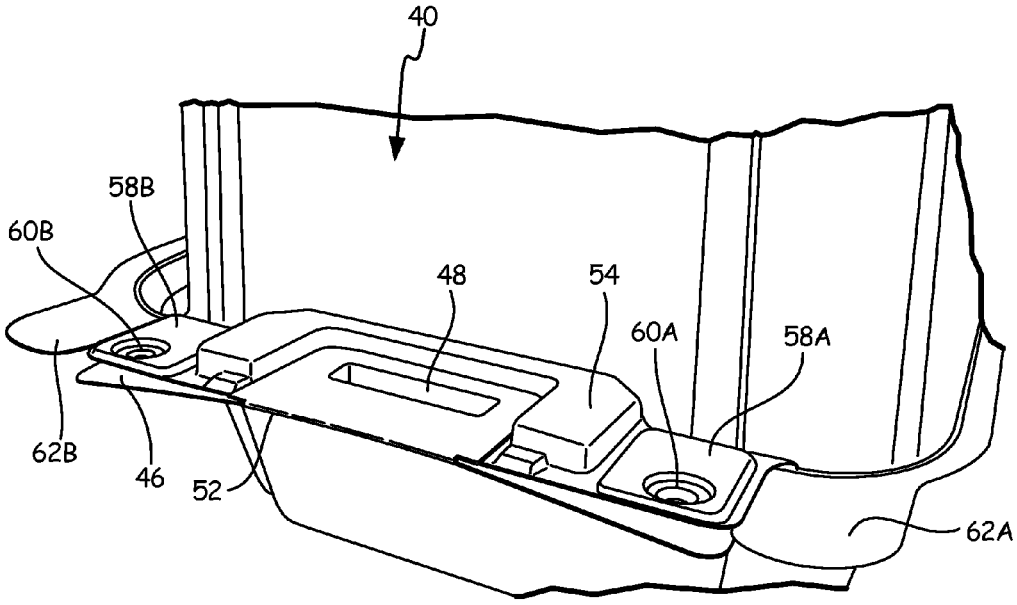
FIG. 7 is a cut-away perspective view of a bottom side of the tamper evident closure shown in FIG. 6.

FIG. 6 is a cut-away perspective view of a top side of tamper evident closure 40. FIG. 7 is a cut-away perspective view of a bottom side of tamper evident closure 40. Tamper evident closure 40 includes first snap 42, second snap 44, tear strip 46, third snap 48, perforated line 50, perforated line 52, projection 54, projections 56, tabs 58, bumps 60, and tabs 62.

As seen in FIG. 6, when tamper evident closure 40 is in a closed position, bumps 60 create a gap between opposite ends of tear strip 46 and tabs 58. This gap makes it easy for a user to grasp an end of tear strip 46 and pull it away from container 20 along perforated line 50 and perforate line 52.

As seen in FIG. 7, when taper evident closure 40 is in a closed position, projection 54 surrounds three edges of third snap 48. Projection 54 prevents a user from prying third snap 48 out of first snap 42, as it is very difficult, if not impossible, to grasp an edge of third snap 48. Further, even if a user were able to grasp an edge of third snap 48, perforated line 52 would tear when trying to remove third snap 48 from first snap 42. This would indicate to a user that container 20 has been tampered with.

In the embodiment shown, tamper evident container 20 is a clamshell container with first container portion 34 connected to second container portion 36 along hinge 38. In alternate embodiments, tamper evident container 20 can be a multi-piece container. Further, in alternate embodiments, the number of tamper evident closures can vary and can include more than one tamper evident closure. Additionally, the size, shape, and placement of the tamper evident closures can vary depending on the structure of the container.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A tamper evident closure comprising:

a first snap;

a second snap;

a tear strip connected to the second snap;

a third snap connected to the tear strip;

a first projection extending around three sides of the first snap;

a second projection on a first side of the second snap; and a third projection on a second side of the second snap;

wherein in a closed position, a cavity of the second snap is configured to be placed over the first snap, and the third snap is configured to be placed in a cavity in the first snap; and wherein in a closed position, the first projection is configured to surround three sides of the third snap that has been placed in the cavity in the first snap, and the second projection and the third projection are configured to be placed in a cavity in the first projection.

2. The tamper evident closure of claim 1, and further comprising:

a first perforated line connecting the second snap to the tear strip; and a second perforated line connected the tear strip to the third snap.

3. The tamper evident closure of claim 2, wherein the tear strip is configured to be removed from the tamper evident closure by separating the tear strip along the first perforated line and the second perforated line.

4. The tamper evident closure of claim 3, wherein when the tear strip is removed from the tamper evident closure, the first snap and the second snap can be opened and closed repeatedly.

5. The tamper evident closure of claim 1, and further comprising:

a first tab on a first side of the first snap;

a second tab on a second side of the first snap;

a first bump on the first tab; and a second bump on the second tab.

6. The tamper evident closure of claim 5, wherein when the tamper evident closure is in a closed position, a first end of the tear strip is configured to abut the first bump on the first tab and a second end of the tear strip is configured to abut the second bump on the second tab.

7. The tamper evident closure of claim 1, and further comprising:

a third tab on the first side of the second snap; and a fourth tab on the second side of the second snap;

wherein the third tab and the fourth tab are configured to be grasped by a user to open and close the tamper evident container.

8. The tamper evident closure of claim 1, wherein the first snap can be removed from the cavity of the second snap.

9. The tamper evident container of claim 1, wherein the third snap has a tight fit with the cavity of the first snap and cannot be removed from the cavity of the first snap.

10. A tamper evident container comprising:

a first container portion;

a second container portion; and the tamper evident closure of claim 1.

11. The tamper evident container of claim 10, wherein the first container portion and the second container portion are attached with a hinge.

12. The tamper evident container of claim 10, wherein the first container portion and the second container portion are two separate pieces.

13. A method comprising:

closing a tamper evident container by bringing a first container portion into contact with a second container portion;

placing a cavity of a second snap over a first snap, wherein the second snap is connected to a tear strip along a first perforated line and the tear strip is connected to a third snap along a second perforated line, and wherein a first projection extends around three sides of the first snap, a second projection is positioned on a first side of the second snap, and a third projection is positioned on a second side of the second snap, wherein when the cavity of the second snap is placed over the first snap, the second projection and the third projection are placed in a cavity in the first projection;

folding the third snap along the second perforated line; and placing the third snap in a cavity of the first snap, wherein when the third snap is in the cavity of the first snap, the first projection surrounds three sides of the third snap.

14. The method of claim 13, and further comprising:

tearing the tear strip along the first perforated line and the second perforated line;

discarding the tear strip;

opening the tamper evident container by separating the first snap from the second snap.

15. The method of claim 14, and further comprising:

grasping a first end of the tear strip, wherein there is a gap between the first end of the tear strip and a first tab.

16. The method of claim 14, wherein opening the tamper evident container includes grasping a second tab on a first side of the second snap to pull the second container portion away from the first container portion.

17. The method of claim 14, wherein when the tamper evident container is opened, the third snap remains in the cavity of the first snap.

18. A tamper evident closure comprising:

a first snap;

a second snap;

a tear strip connected to the second snap;

a third snap connected to the tear strip;

a first projection extending around three sides of the first snap;

a first tab on a first side of the first snap;

a second tab on a second side of the first snap;

a first bump on the first tab; and a second bump on the second tab;

wherein in a closed position, a cavity of the second snap is configured to be placed over the first snap, and the third snap is configured to be placed in a cavity in the first snap; and wherein in a closed position, the first projection is configured to surround three sides of the third snap that has been placed in the cavity in the first snap.

19. The tamper evident closure of claim 18, wherein when the tamper evident closure is in a closed position, a first end of the tear strip is configured to abut the first bump on the first tab and a second end of the tear strip is configured to abut the second bump on the second tab.

20. A tamper evident container comprising:

a first container portion;

a second container portion; and the tamper evident closure of claim 18.

21. A method comprising:

closing a tamper evident container by bringing a first container portion into contact with a second container portion;

placing a cavity of a second snap over a first snap, wherein the second snap is connected to a tear strip along a first perforated line and the tear strip is connected to a third snap along a second perforated line, and wherein there is a first tab on a first side of the first snap with a first bump on the first tab, and a second tab on a second side of the first snap with a second bump on the second tab;

folding the third snap along the second perforated line; and placing the third snap in a cavity of the first snap, wherein when the third snap is in the cavity of the first snap, a projection surrounds three sides of the third snap.

22. The method of claim 21, and further comprising:

grasping a first end of the tear strip, wherein the first bump on the first tab forms a gap between the first end of the tear strip and the first tab.

* * * * *